US005518153A

United States Patent [19]

Zacharias et al.

[11] Patent Number: 5,518,153

[45] Date of Patent: May 21, 1996

[54] TUNDISH IMPACT PAD

[75] Inventors: Donald R. Zacharias, Parma; Bryce R. Jardine, Brunswick, both of Ohio

[73] Assignee: Foseco International Limited, Birmingham, England

[21] Appl. No.: 338,123

[22] Filed: Nov. 9, 1994

[51] Int. Cl.[6] ..... C21B 7/14

[52] U.S. Cl. ..... 222/594; 266/275; 75/584

[58] Field of Search ..... 266/275, 280, 266/227, 229; 222/594; 75/584

[56] References Cited

U.S. PATENT DOCUMENTS

| | | | |
|---|---|---|---|
| 3,887,171 | 6/1975 | Neuhaus | 266/275 |
| 4,776,570 | 10/1988 | Vo Thanh et al. | 266/229 |
| 5,169,591 | 12/1992 | Schmidt et al. | 266/275 |
| 5,358,551 | 10/1994 | Saylor | 222/594 |

OTHER PUBLICATIONS

Preventur advertisement., COMAT Co. "Turbulence Inhibiting Tundish Pour Pad" Dec. 16, 1993.

Isenberg–O'Loughlin, "Taming the Thunder" 33 Metalproducing, pp. 21–23 and 47. Sep. 1994.

*Primary Examiner*—Scott Kastler

*Attorney, Agent, or Firm*—Nixon & Vanderhye

[57] ABSTRACT

A tundish impact pad has a non-uniform construction with a long dimension and a short dimension perpendicular to the long dimension, the long dimension of the impact pad disposed aligned with the long dimension of the tundish on the tundish floor. The impact pad is a body of refractory material capable of withstanding continuous contact with molten steel during the entire use cycle of the tundish. The body has a base with an impact surface, an endless outer side wall extending upwardly from the impact surface, and a top surface substantially parallel to the impact surface and connected to the side wall and defining a non-uniform opening. The side wall also has an interior face which is semi-circular about an axis substantially parallel to the impact surface around the entire extent thereof, or channel-shaped, so that molten steel contacting the impact surface flows outwardly, then in turn inwardly then directed upwardly by the side wall interior face, and then flows out the opening. The opening may be substantially rectangular or oval. The outer side wall may be tapered inwardly at opposite ends at the base and include ears which facilitate mounting of the body in place in a tundish, or may be straight.

10 Claims, 2 Drawing Sheets

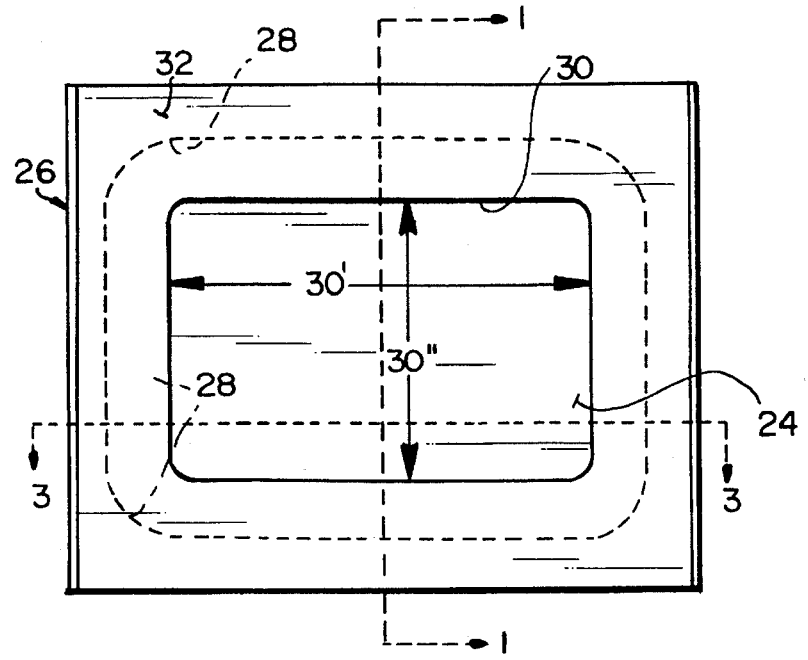
FIG. 2
FIG. 3
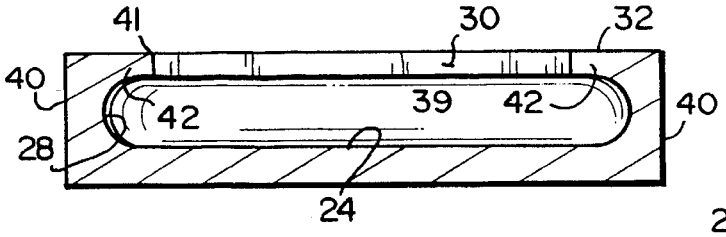
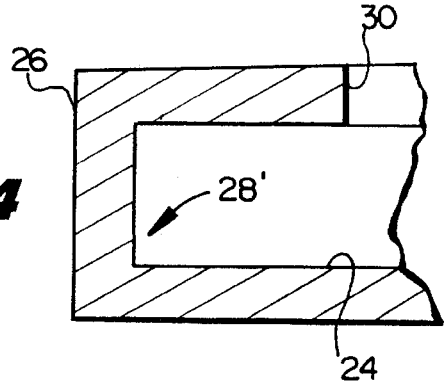
FIG. 4
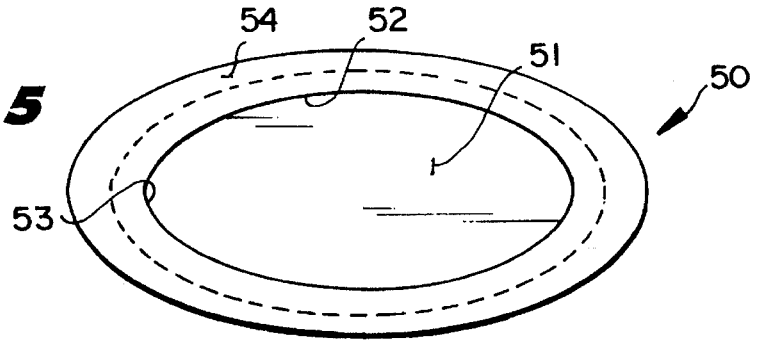
FIG. 5

TUNDISH IMPACT PAD

BACKGROUND AND SUMMARY OF THE INVENTION

U.S. Pat. No. 5,169,591 shows an impact pad for a tundish for continuous casting of steel that is a significant advance over the art. The impact pad as illustrated and described in that patent can substantially eliminate surface turbulence in a continuous casting tundish as well as providing other advantages including minimization of slag entrainment within the liquid steel bath in the tundish, prevention of the breakup of tundish flux cover and reoxidation of the liquid steel bath, and ensuring a proper flow path of the steel within the tundish.

While the particular design of the impact pad actually illustrated in the drawings of the U.S. Pat. No. 5,169,591 patent is ideally suited for certain combinations of tundish design and casting conditions, while for other combinations of tundish design and casting conditions a modification thereof is more desirable. It has been found according to the present invention that particularly for combinations of tundish design and casting conditions where the additional benefits of increased inclusion flotation or reduced volume of mixed steel chemistry upon grade changes are sought, it is desirable to provide an impact pad having an annular (closed) configuration. It has also been found according to the present invention, however, that the annular configuration must be non-uniform. That is the opening provided in the impact pad into which the liquid steel flows must be longer along the long axis of the tundish than it is along the short axis. The preferred configuration of the impact pad is rectangular, although oval or other polygon shapes may be provided as long as they are non-uniform (e.g. not circular or square).

The impact pads according to the present invention uniformly disperse the flow of incoming steel, rather than merely redirecting it. Since the steel flow can be dispersed over a larger area than if a circular or other uniform configuration were used, the result is more uniformly surface directed flow while maintaining the benefits of reduced splash and turbulence. Also due to the non-uniform configuration of the impact pad it presents a larger "target" to the incoming steel than a similar width uniform shaped pad (e.g. circular or square), with the desired results obtained even if the steel stream is imperfectly aligned with the center of the impact pad.

It is also highly desirable that the impact pad according to the present invention have a completely semi-circular, or extended semi-circular, configuration of the flow re-directing portions beneath the top of the pad and between the top of the pad at the opening thereof and the bottom of the pad toward which the steel is directed. This configuration—which utilizes no corners—minimizes cracks during manufacture, and reduces the potential for erosion. However it is not necessary that the inner side wall be semi-circular—it can be channel-shaped, and it can have sharp corners.

The impact pads according to the present invention are formed of a refractory composition which is capable of withstanding continuous contact with molten metal, in particular molten steel such as used in continuous casting operations. Usually a standard medium-to-high alumina monolithic refractory, with an alumina content in the range of about 55–85%, is desirable. Where a basic refractory is preferred because of steel chemistry it is preferred that a magnesia based monolithic refractory be utilized, with MgO in the range of about 58–93%.

According to one aspect of the present invention a tundish impact pad formed of a refractory composition capable of withstanding continuous contact with molten steel is provided comprising a base having an impact surface and an endless outer side wall extending outwardly from the base, and fully enclosing an interior space having an upper opening for receiving a stream of molten metal. The outer wall includes an annular inner surface having at least a first portion extending inwardly and upwardly toward the opening so that when a downwardly directed stream of molten steel from a location (e.g. ladle outlet) disposed above the impact pad strikes the impact surface, the stream is directed outwardly toward the annular inner surface and then redirected upwardly and inwardly toward the incoming metal stream.

The annular inner surface typically includes a second portion extending outwardly and upwardly from the impact surface toward the first portion and at least one of the first and second portions is a concave annular surface. Preferably a semi-circular surface, elongated at the ends of the semi-circle, is provided. The interior space may be rectangular or oval in shape, or of another polygon shape, as long as it is non-uniform (that is having a longer dimension along the long axis of the tundish than along the short axis). A vertically oriented annular surface may extend upwardly from the first portion and define the opening.

According to another aspect of the present invention in a tundish for holding a volume of molten steel and having a floor and side walls enclosing a region of impact, and a drain, according to the invention an improvement is provided in the form of an impact pad. The impact pad is preferably as described above.

According to yet another aspect of the present invention a method of reducing turbulence and high velocity flow of molten metal (steel) in a tundish is provided. The method comprises the following steps: Providing an impact pad within the tundish, the impact pad including an endless outer side wall extending upwardly therefrom and fully enclosing an interior spacing having an upper opening for receiving a stream of the molten metal, the outer wall including an annular inner surface having at least a first portion extending inwardly and upwardly toward the opening. Directing an incoming stream of molten metal vertically downwardly into the tundish and against the impact pad from a location disposed above an upper edge of the impact pad to create a bath of molten metal in the tundish. Reversing the stream into a vertically upward and inward direction toward the incoming stream. And, creating generally radially outward flows of the molten metal in the tundish on all sides of the incoming stream such that the flows are each directed away from the incoming stream toward the surface of the bath of molten metal.

According to yet still another aspect of the present invention a tundish impact pad is provided comprising the following elements: A body of refractory material capable of withstanding continuous contact with molten steel during the entire use cycle of a tundish. The body comprising a base having an impact surface, an endless outer sidewall extending upwardly from the impact surface, a top surface substantially parallel to the impact surface and connected to the sidewall and defining a non-uniform opening therein, the non-uniform opening having a long dimension and a short dimension perpendicular to the long dimension. And, the sidewall having an interior face which is semicircular about an axis substantially parallel to the impact surface around the entire extend thereof, so that molten steel contacting the impact surface flows outwardly, then is turned inwardly and directed upwardly by the sidewall interior face, and then flows out the opening. The opening is typically substantially rectangular or substantially oval and the body of refractory material preferably comprises a monolithic refractory having about 55–85% alumina, or about 58–93% MgO. The outer side wall may be tapered inwardly at opposite ends thereof, and it may include first and second ears extending outwardly from the opposite ends at said base, which ears facilitate mounting of the body in place in a tundish.

According to another aspect of the invention a tundish assembly is provided which comprises the following elements: A tundish including a floor, a plurality of sidewalls, an open top, and a plurality of outlets in the floor spaced from a central portion thereof, the tundish having a long dimension and a short dimension. And, an impact pad disposed on the floor at the central portion thereof, the impact pad comprising: a body of refractory material capable of withstanding continuous contact with molten steel during the entire use cycle of a tundish; the body comprising a base having an impact surface, an endless outer sidewall extending upwardly from the impact surface, a top surface substantially parallel to the impact surface and connected to the sidewall and defining a non-uniform opening therein, the non-uniform opening having a long dimension and a short dimension perpendicular to the long dimension; and the sidewall having an interior face which is semicircular about an axis substantially parallel to the impact surface around the entire extend thereof, or channel-shaped, so that molten steel contacting the impact surface flows outwardly, then is tuned inwardly and directed upwardly by the sidewall interior face, and then flows out the opening. And, wherein the long dimension of the non-uniform opening is substantially aligned with the long dimension of the tundish, and the short dimension of the non-uniform opening is substantially aligned with the short dimension of the tundish.

It is the primary object of the present invention to provide tundish impact pads which are very desirable for many different types of tundishes. This and other aspects of the invention will become clear from an inspection of the detailed description of the invention and from the appended claims.

BRIEF DESCRIPTION OF THE DRAWINGS

FIG. 2 is a top plan view of the turbulence inhibiting pad per se illustrated in FIG. 1, which illustrates where the cross-section of FIG. 1 is taken (along lines 1—1);

FIG. 3 is a cross-sectional view of the pad of FIG. 2 taken along lines 3—3 thereof;

FIG. 4 is a view like that of FIG. 3 showing only part of the pad, with a channel-shaped rather than semi-circular inner wall; and FIG. 5 is a top plan view of an alternative embodiment of an impact pad according to the invention.

DETAILED DESCRIPTION OF THE DRAWINGS

Figure 1:
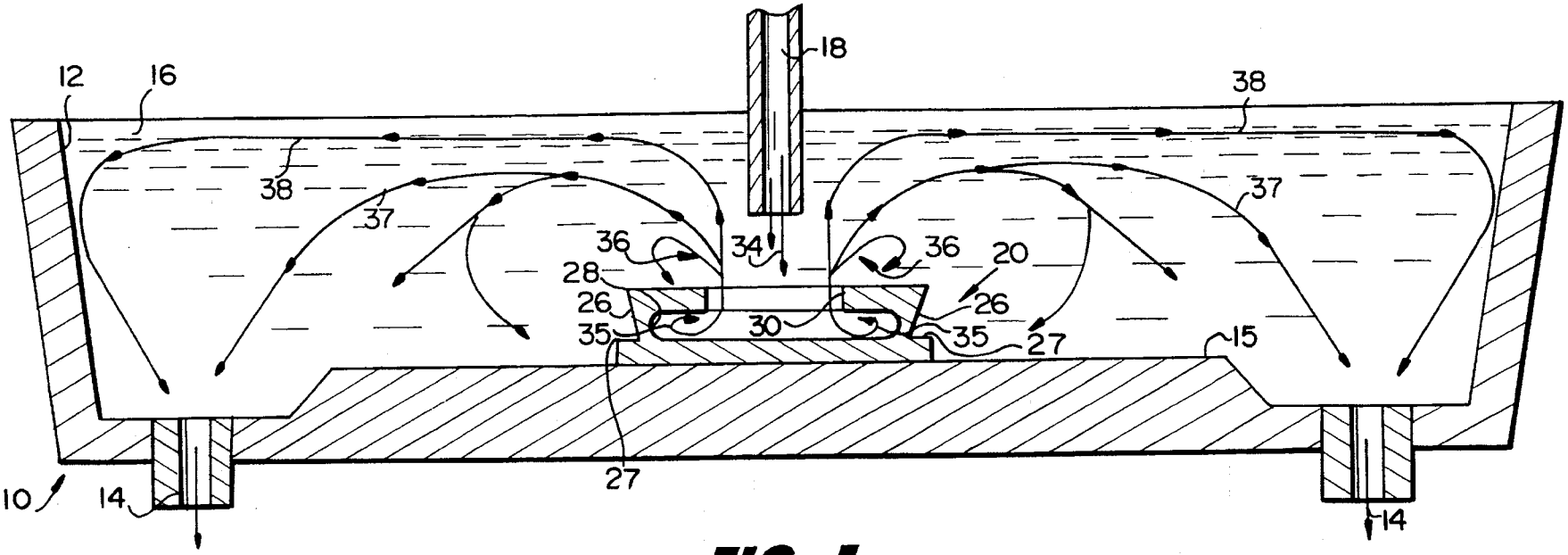
FIG. 1 is a side cross-sectional view of a tundish including a turbulence inhibiting impact pad according to the present invention disposed on the bottom of the tundish.

In FIG. 1, a conventional tundish 10 is shown and includes an inner lining 12 and a pair of well blocks or outlets 14 for allowing molten metal (typically steel) from a bath 16 contained in the tundish 10 to continuously exit the tundish 10 and enter molds (not shown) which form metal castings. As is also conventional, a ladle shroud 18, or like tundish filling device, is positioned above the tundish 10 and continuously directs a stream of molten metal into the tundish 10. A tundish impact pad 20 constructed according to the present invention is placed generally centrally on the floor of the tundish 10.

As seen in FIGS. 1–3, the tundish impact pad 20 is preferably rectangular in shape and includes a base 22 having a planar, horizontal, impact surface 24. The pad 20 further includes an endless, annular outer side wall 26, 40 having an inner wall face surface 28. The impact pad 20 also has a top surface 32 parallel to the impact surface 24 and connected to the side wall 26, 40 and defining a non-uniform opening 30 therein. By "non-uniform" it is meant that the opening 30 is not circular or square; rather it has a long dimension 30' (see FIG. 2) and a short dimension 30" substantially perpendicular the long dimension 30'.

As seen in all of FIGS. 1 through 3, the interior face 28 of the side wall is preferably semi-circular about an axis (a horizontal axis) substantially parallel to the impact surface 24 around the entire periphery thereof, there preferably being no corners in which the molten steel might collect and erode more quickly the refractory material forming the impact pad 20. The continuously semi-circular, curved, nature of the inner surface 28 is perhaps seen most clearly in FIG. 2, being shown in dotted line therein. The entire surface 28 is preferably devoid of corners. However, as shown in FIG. 4, if ease of manufacturing or other factors indicate it, the side wall 28' can be channel-shaped, with or without sharp corners. As seen in FIG. 4, the side wall 28' has a substantially right angle interface/corner—as indicated by reference numeral 33—with the impact surface 24, and another substantially right angle interface/corner—as indicated by reference numeral 35—with the annular portions 39, 42 of the bottom (inner) annular portion of the top surface 32 (the portions 39, 42 substantially parallel to the impact surface 24).

As seen in FIG. 1, the outer side wall 26 may be tapered inwardly from the top surface 32 toward the base 22, defining ears 27 at opposite ends. The ears 27 facilitate connection of the impact pad 20 to the base or floor 15 of the tundish when certain types of tundishes are utilized. Alternatively the impact pad 20 may merely be molted in a conventional manner on the bottom of the tundish, as shown in U.S. Pat. No. 5,169,591 (the disclosure of which is hereby incorporated by reference herein).

It is also noted that the bottom portion of the top surface 32 has annular portions 39, 42 (see FIG. 3) thereof which parallel to the impact surface 24. This annular, overhang, surface 42 facilitates proper directing of the molten steel during filling of the tundish 10. Note that the long dimension 30' of the opening 30 is positioned aligned with the long dimension of the tundish (the dimension between the outlets 14, as seen in FIG. 1), whereas the short dimension 30" of the opening 30 is aligned with the short dimension of the tundish 10.

The outer side wall portions 40, rather than being tapered inwardly like the side wall portions 26, preferably taper very slightly (e.g. 2°–5°) outwardly, as seen in FIG. 3. Alternatively straight sides may be provided for both walls 26, 40, and straight side walls 26 may or may not contain ears 27. See FIG. 4 for a straight line configuration of side wall 26, without ears 27.

The refractory material of which the impact pad 20 is made must be capable of withstanding continuous contact with molten steel during the entire use cycle of the tundish 10. It must have adequate refractoriness normally available from a standard mediums-to-high alumina monolithic refractory. For example an alumina content in the range of about 55–85% may be utilized. Where a basic refractory is preferred because of the steel chemistry, typically an MgO-based monolithic refractory, with MgO in the range of about 58–93%, is preferred.

While it is preferred that the impact pad 20 be rectangular in shape, as illustrated in FIG. 1 through 4, other non-uniform configurations can also be provided. For example an oval impact pad 50—as seen schematically in top view in FIG. 5—may be utilized, or another type of multi-sided polygon configuration, as long as there is a long dimension which is aligned with the long dimension of the tundish 10, and a short dimension aligned with the short dimension of the tundish 10. In the oval configuration of FIG. 5, the impact surface is seen at 51, the opening 52 in the top surface 54 is also oval, and the inner, semi-circular, wall surface 53 is also oval in configuration when viewed from the top.

In use of the tundish pad 20 illustrated in FIG. 1, molten steel flowing in the path 34 from a location disposed above the pad 20 strikes the impact surface 24 and then moves radially outwardly as illustrated by arrows 35. When the steel impacts the inner face 28 of the side wall, it is directed inwardly then upwardly, flowing as illustrated at 36 in FIG. 1 and ultimately being dispersed generally radially outwardly as indicated by arrows 37, 38 in FIG. 1. This minimizes turbulence on the surface of the bath 16 and helps direct slag and other impurities away from the stream 34.

While the invention has been herein shown and described in what is presently conceived to be the most practical and preferred embodiment thereof it will be apparent to those of ordinary skill in the art that many modifications may be made thereof within the scope of the invention, which scope is to be accorded the broadest interpretation of the appended claims so as to encompass all equivalent structures and methods.

What is claimed is:

1. A tundish impact pad comprising:

a body of refractory material capable of withstanding continuous contact with molten steel during the entire use cycle of a tundish;

said body comprising a base having an impact surface, an endless outer sidewall extending upwardly from said impact surface, a top surface substantially parallel to said impact surface and connected to said sidewall and defining a non-uniform opening therein, said non-uniform opening having a long dimension and a short dimension perpendicular to said long dimension;

said top surface having an inner annular portion substantially parallel to said impact surface; and said sidewall having an interior face which is substantially perpendicular to said impact surface, and wherein a substantially right angle corner is provided between said sidewall and said impact surface, and a substantially right angle corner is provided between said sidewall and said top surface inner annular portion, so that molten steel contacting said impact surface flows outwardly, then is turned inwardly and directed upwardly by said sidewall interior face, and then flows out said opening.

2. An impact pad as recited in claim 1 wherein said opening is substantially rectangular.

3. An impact pad as recited in claim 1 wherein said opening is substantially oval.

4. An impact pad as recited in claim 1 wherein said body of refractory material comprises a monolithic refractory having about 55–85% alumina, or about 58–93% MgO.

5. An impact pad as recited in claim 4 wherein said body of refractory material comprises a monolithic refractory having about 55–85% alumina, or about 58–93% MgO.

6. An impact pad as recited in claim 3 wherein said body of refractory material comprises a monolithic refractory having about 55–85% alumina, or about 58–93% MgO.

7. An impact pad as recited in claim 1 disposed in a tundish, with said opening located below a downwardly directed stream of molten metal directed from a location disposed above the impact pad.

8. An impact pad as recited in claim 2 disposed in a tundish, with said opening located below a downwardly directed stream of molten metal directed from a location disposed above the impact pad.

9. An impact pad as recited in claim 4 disposed in a tundish, with said opening located below a downwardly directed stream of molten metal directed from a location disposed above the impact pad.

10. An impact pad as recited in claim 5 disposed in a tundish, with said opening located below a downwardly directed stream of molten metal directed from a location disposed above the impact pad.

* * * * *